United States Patent [19]

Reiter

[11] Patent Number: 5,016,402

[45] Date of Patent: May 21, 1991

[54] SANDING APPARATUS WITH INTERCHANGEABLE BASES AND HANDLES

[76] Inventor: John P. Reiter, 10407 Quebec Ave. South, Bloomington, Minn. 55438

[21] Appl. No.: 377,329

[22] Filed: Jul. 10, 1989

[51] Int. Cl.[5] ..... B24D 15/00

[52] U.S. Cl. ..... 51/393; 51/392; 51/358

[58] Field of Search ..... 51/393, 392, 181 R, 51/170 MT, 170 LB, 170 TL, 358, 359, 391, 401, 406, 407

[56] References Cited

U.S. PATENT DOCUMENTS

| | | | |
|---|---|---|---|
| 1,822,856 | 9/1931 | Dirker | 51/406 |
| 2,434,356 | 1/1948 | Finkelstien | 51/392 |
| 2,437,827 | 3/1948 | Lund | 51/392 |
| 2,490,419 | 12/1949 | Crosby | 51/393 |
| 3,123,947 | 3/1964 | Rawley | 51/392 |
| 3,498,009 | 3/1970 | Taafe | 51/393 |
| 3,892,091 | 7/1975 | Hutchins | 51/392 |
| 4,263,755 | 4/1981 | Globus | 51/406 |
| 4,437,269 | 3/1984 | Shaw | 51/406 |
| 4,676,031 | 6/1987 | Reiter | 51/392 |
| 4,774,789 | 10/1988 | Amalfi | 51/393 |

FOREIGN PATENT DOCUMENTS

| | | | |
|---|---|---|---|
| 868667 | 4/1971 | Canada | 51/392 |

*Primary Examiner*—Frederick R. Schmidt
*Assistant Examiner*—Blynn Shideler
*Attorney, Agent, or Firm*—Haugen and Nikolai

[57] ABSTRACT

A kit including a plurality of sandpaper supporting devices, each of differing length and/or width dimension whereby areas of varying size and contour may more readily be finished in an abrading process. Each of the devices includes a plate member of a predetermined length and width dimension, the plate being sufficiently flexible to conform to the contour of the surface being finished. One or more handle members of varying types are releasibly attached to one major surface of the plate. A knobby elastomeric pad is removably attached to the other major surface of the plate, preferably using Velcro® strips. The knobby pad serves as a backing or support for an abrasive sheet (e.g. sandpaper) of a width and length corresponding to the dimensions of the plate member. When the supporting devices are to be used with an airfile, a special adapter is used which is coupled to the supporting device and permits flexure of the supporting devices.

12 Claims, 2 Drawing Sheets

SANDING APPARATUS WITH INTERCHANGEABLE BASES AND HANDLES

BACKGROUND OF THE INVENTION

I. Field of the Invention

This invention relates generally to apparatus for facilitating the repair and refurbishment of damaged surfaces, and more particularly to a kit including a plurality of sandpaper supporting devices which may readily be adapted to conform to the characteristics of the work area to be finished in an abrading operation, the device being either hand operated or machine powered.

II. Discussion of the Prior Art:

In auto body repair or in the repair of fiberglass hulls on marine craft, damaged areas are generally filled with a metal or plastic and, following that, a rotary grinder may be used to grind down the filling material until the original lines or contours are approximated. Following that, a hand sanding operation is generally carried out in repeated steps and with finer and finer grit abrasive paper until the surface being treated is smooth, free of waves and ready for painting.

It has been found difficult to create an acceptable surface when a sheet of sandpaper, either folded or unfolded, is held in the palm of the body repairman's hand and rubbed back and forth across the area being refinished. Any irregularities tend to show up as surface imperfections when the painting has been completed. Irregular patterns often result from hand-held abrasive paper as do waves and finger marks due to the non-uniform pressure being applied. It is also known that sandpaper can be mounted on a sanding block having a planar surface, but oftentimes such blocks are too inflexible to permit the abrasive sheet to conform to the contours of the surface being treated, especially if the surface is curved rather than flat.

Not only should the sanding block be of a predetermined flexibility, but, moreover, blocks of varying width and length dimensions are needed if the labor involved is to be reduced. That is to say, where large surfaces, such as marine hulls, automotive side panels, trunk lids and hoods are involved, a longer and wider sandpaper supporting block may be employed such that larger areas can be abraded in a few passes of the hand sanding apparatus, thus saving on labor costs. Shorter blocks may generally become useful where sharper corners or surface transitions are encountered.

The 3M Company of St. Paul, Minn., is a major supplier of abrasive papers to automobile body shops and marine repair facilities. These sandpapers come in varying grits and generally are dispensed from a roll, the rolls coming in two different width dimensions. The non-abrasive surface of the papers are generally coated with an adhesive, facilitating the securement of the paper to a sanding block. When it becomes necessary to change the paper to obtain a different abrasive grit, it has been the practice in the past to peel off the original length of abrasive paper from the sanding block and then replace it with a new piece having the desired grit. When it is considered that the first piece being replaced may still have from 50% to 90% of useful life and that the environment of a body shop is extremely dusty and dirty, the partially used piece of sandpaper often becomes totally unusable when the adhesive backing becomes coated with dust and dirt so that it cannot be reapplied to the sanding block at a later time. Thus, while it would be advantageous to be able to reuse sandpapers whose abrasive qualities have not been totally used up, this has heretofore been impossible because once the partially used piece of sandpaper has been stripped from its sanding block and allowed to sit in a dusty environment, its adhesive backing loses its tackiness.

Prior art sandpaper supporting blocks also incorporate a variety of styles of handles for facilitating their gripping and manipulation of the sanding blocks during use. For example, for shorter sanding blocks, only a single handle member may be required. Longer sanding blocks, e.g., those about 2½ feet in length, will generally have two handles spaced along the length dimension of the sanding block. Then, too, the shape of the handle, e.g., its height or contour may vary depending upon the surface or surfaces to be abraded and the desires of the user. With prior art sanding arrangements, it has been necessary to provide a large multiplicity of sanding blocks, given the many permutations and combinations of block length, block width, handle location and handle geometry. This necessitates an inordinately high number of sanding blocks, each equipped with its own handle (or set of handles) to accommodate the variety of contours that may be encountered during a body finishing operation.

SUMMARY OF THE INVENTION

In accordance with the present invention, all of the foregoing drawbacks of prior art sandpaper supporting devices for surface refinishing are obviated In particular, the sandpaper medium can be readily removed and replaced with one of a different grit without wasting a partially worn segment of sandpaper. Moreover, different sandpaper holding devices are provided with replaceable handles of a limited number of styles, allowing the operator to select the sanding block size and handle style to suit his immediate needs.

The present invention provides a kit in which a plurality of plate members of differing width and length dimensions are provided as are a plurality of handle members of differing size and shape configuration. Means are provided for rapidly securing and removing the handle members onto or from any of the selected plate members with the securing means allowing the handles to be located at any of a number of desired locations along the length of t hat plate member.

The adhesive backed sandpaper is arranged to be attached to a base which, in turn, removably attaches to the plate member bearing the handles. The base can be stripped away from the plate member carrying the handles and a new base member having a sandpaper of a differing grit can then be substituted. Thus, the adhesive backing on the sandpaper is not exposed to dirt and contamination when a paper of a different grit is substituted. This allows an already used, but not yet worn out, abrasive paper to be reused, thus reducing cost.

OBJECTS

It is accordingly a principal object of the present invention to provide a new and improved sanding system for facilitating the repair and refurbishment of damaged surfaces.

Another object of the invention is to provide, as a kit, a plurality of sandpaper supporting devices, which may readily be adapted to conform to the characteristics of the work area to be finished in an abrading operation, and having means for releasibly attaching one or more handle members to the supporting device.

Yet another object of the invention is to provide, as a kit, a plurality of sandpaper supporting devices in which the abrasive medium can be removed from the supporting device without exposing the adhesive coating on the sandpaper to contamination.

The foregoing objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
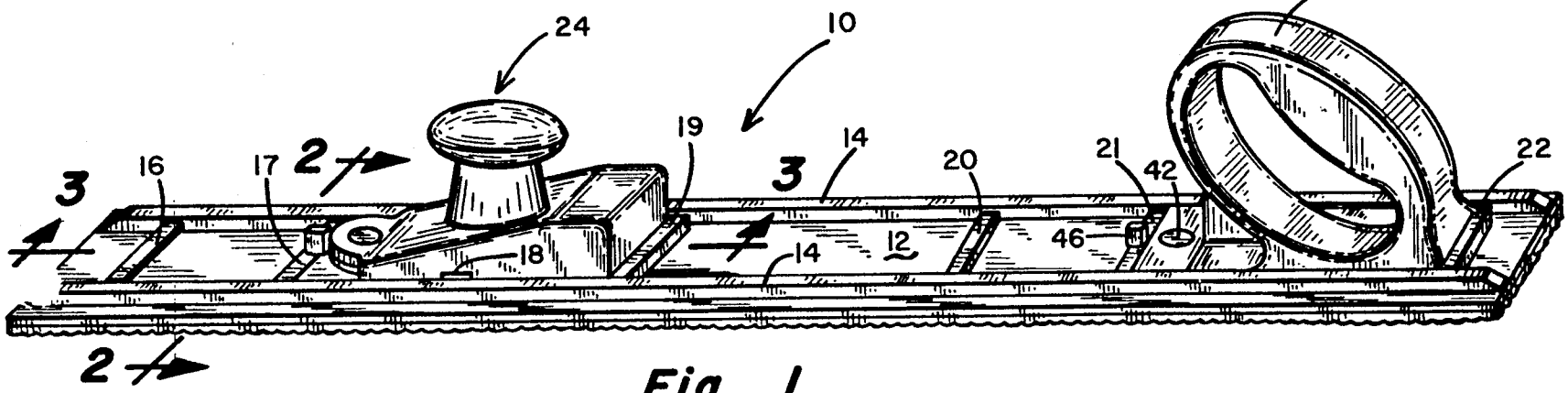
FIG. 1 is a perspective view of the hand sanding apparatus of the present invention.

Referring first to FIG. 1, there is indicated generally by numeral 10 one member of a hand sanding kit useful in the repair of damage to automobiles and fiberglass boat hulls. The general purpose of the device of FIG. 1 is to support, i.e., back-up, a sheet of abrasive material such as sandpaper. The members of the kit would be of varying length, but otherwise would be substantially identical. Hence, it should only be necessary to describe the constructional features of one member of the kit for the reader to have an overall comprehension of the invention.

The device 10 comprises a first, generally flat, somewhat rigid plate member 12 of a predetermined length and width dimension and exhibiting a limited degree of flexibility in a direction transverse to the length dimension of the tool. By way of example, and not as a limitation, the plate member may be 2.75 inches in width and, depending upon the characteristics of the workpiece to be abraded, may be of a length anywhere in the range of from about 6 inches to 36 inches. Again, without limitation, the plate member 12 may be fabricated from sheet metal such as aluminum or cold rolled steel, but I have found that a polycarbonate plastic sheet material, such as that sold under the trademark LEXAN ®, possesses the characteristics of being easy to work with, relatively low in cost, and being very rugged and able to hold up over a substantial period of time.

Integrally molded with the plate member 12 and extending parallel to the length dimension thereof are a pair of rails 14–14. Alternatively, the rails 14 may be thermally or adhesively bonded to the base plate 12 and function to provide a desired degree of flexibility to the assembly so that a certain degree of manual forces required to bend or otherwise distort the tool so as to conform to the surface of the workpiece to be abraded.

Figure 3:
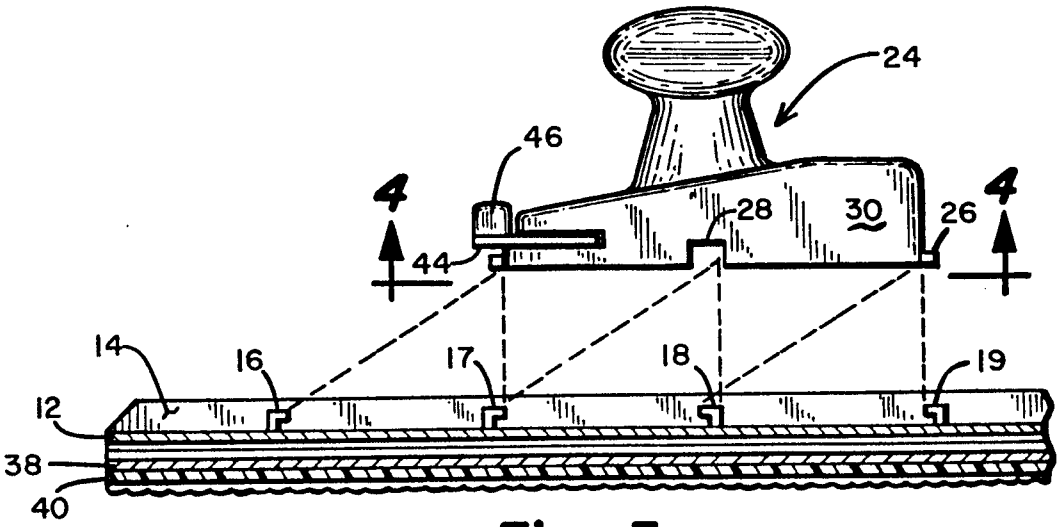
FIG. 3 is a cross-sectional view taken along the line 3—3 in FIG. 1.

Also secured to the upper exposed major surface of the plate member 12 are pairs of transversely extending ribs identified in FIG. 1 by the numerals 16 through 22. As shown in the cross-sectional view of FIG. 3, the ribs 16 through 19 are under cut to allow a handle means indicated generally by numeral 24 to be releasibly attached to the upper surface of the plate member 12 at predetermined discrete locations along the length dimension thereof. For example, and as indicated by the dotted lines, the handle means 24 can be dropped vertically downward as shown in FIG. 3 and latched to the base member by inserting the rearwardly projecting tab 26 on the handle means into the undercut portion of the rib 19 at which point a cam actuated latch yet to be described can be deployed to fit within the undercut portion of the rib 17. The rib 18 will then fall within a transverse notch 28 formed in the base portion 30 of the handle means 24. Alternatively, the tab 26 can be selectively inserted into the undercut portion of the rib 18 with rib 17 fitting in the slot 28 and the cam actuated tab deployed in the cutout portion of the rib 16.

Depending upon the length of the tool, it may have only one such handle means as at 24. However, for base plates of a predetermined greater length, it is found convenient to provide a second handle means as at 32 which itself is releasibly attachable to the upper surface of the base plate 12 in the same fashion that the handle means 24 is secured. Thus, the handle means 32 can be selectively deployed at a desired position along the length of the tool so as to provide a desired degree of control to the tool when using both hands to manipulate it much like a carpenter's plane.

Figure 2:
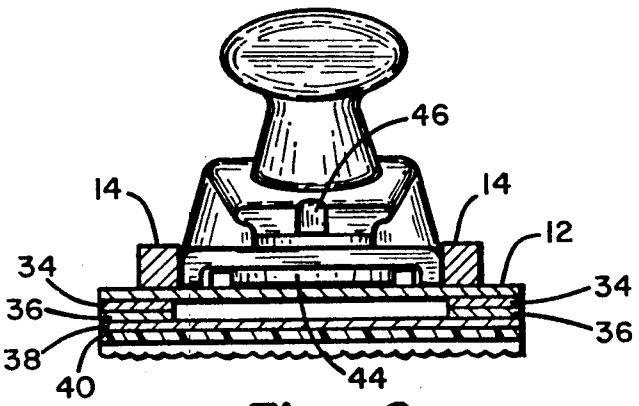
FIG. 2 is a cross-sectional view of the apparatus of FIG. 1 taken along the line 2—2.
Figure 4A:
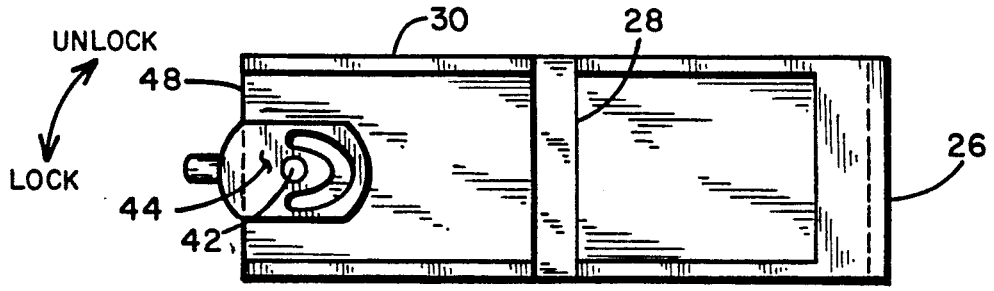
FIG. 4*ak* and FIG. 4*b* are cross-sectional views taken along the line 4—4 in FIG. 3 with the hand grip locking latch in its two operating positions.
Figure 4B:
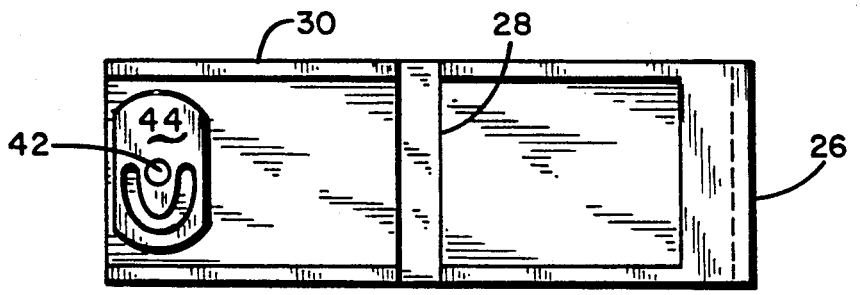

As best seen in the cross-sectional views of FIGS. 2 and 3, mating strips 34 and 36 of Velcro ® hook and loop material are adhered to a second major surface of the plate member 12, i.e., its under surface, and to the upper surface of a further flexible planar sheet 38. The sheet 38 may be fabricated from an appropriate material including metals or plastics, but LEXAN polycarbonate plastic is again preferred for the reasons already indicated. Adhered to the under side of the sheet 38 is a layer 40 of resilient pad material such as knobby NEOPRENE to which an adhesive coated sheet of sandpaper (not shown) can be adhered. Because of the use of the Velcro hook and loop material, the plate 38, pad 40 and the sandpaper adhered to it can be removed as a unit from the plate member 12 and replaced with a similar assembly only containing an abrasive sheet having a different grit. Thus, as the need demands, the type of sandpaper can be substituted or replaced without having to throw the first sheet away before it has been completely used. As shown in FIG. 3, the views of FIGS. 4*a* and 4*b* illustrate the underside of the hand grip means 24. The base or pedestal portion 30 of the handle means 24 has a rivet or pin 42 as an axis passing through it and through a latch plate 44 to which a thumb lever 46 is attached. By manipulating the thumb lever 46, a portion of the latch plate 44 can be either made to project outwardly from the end 48 of the pedestal 30 or be retracted relative to it. Thus, in installing the handle 24 onto the base plate 12, the lever 46 would be positioned so that the latch plate is retracted. Then, the user would deploy the tab portion 26 of the pedestal into the undercut portion of one of the ribs with the sides of the pedestal being straddled by the longitudinal rails 14. Next, by rotating the latch lever 46, the nose portion of the latch plate 44 can be made to project into a mating undercut portion of a rib to firmly lock the handle means to the plate member 12.

It is also contemplated that the sanding apparatus of FIG. 1 can also be utilized with a so-called airfile. As those familiar with tools used in the automobile and marine repair business appreciate, an airfile is a device that can be connected to a source of compressed air and used to rapidly reciprocate a backup member supporting a sheet of abrasive material. This, of course, facilitates the sanding operation in that the operator need merely guide the reciprocating tool over the surface to be treated and need not himself provide the back and forth motion to achieve the abrading result. The airfile apparatus, however, is completely rigid and generally would not conform to curved surfaces. In accordance with the present invention, an adapter shown in FIGS. 5, 6*a* and 6*b* can be used in place of the handle means 24 and 32 of FIG. 1 to join an airfile to the base plate 12 in such a fashion that flexure of the base plate 12 can still take place.

Figure 5:
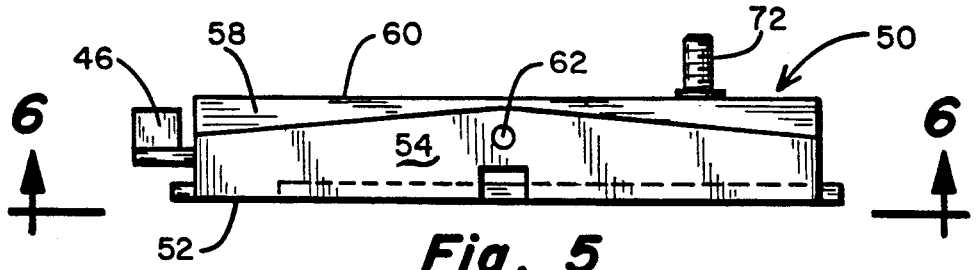
FIG. 5 is a side view of the airfile adapter usable with the hand sanding apparatus of FIG. 1.

With reference to FIG. 5, the airfile adapter member is indicated generally by numeral 50 and is seen to include a planar base 52 which, as indicated below, is releasibly attachable to the upper exposed surface of the plate member 12 in a somewhat similar fashion to the manner in which the handle members 24 attach. The adapter 50 also includes first and second side walls 54 and 56 projecting perpendicularly to the planar base 52. The side walls have a sloping contour and go from a minimum height at the opposed ends of the side walls to a maximum height approximately midway along the length dimension of the side walls. A channel-shaped member 58 having a planar airfile attachment surface 60 is pivotally supported between the side walls 54 and 56 for limited rotation about an axis provided by a pin 62 disposed approximately at the maximum height location of the side walls 54 and 56 and passing through aligned apertures. Thus, the surface 60 can rock, to a limited degree, in the clockwise and counterclockwise direction when viewed in FIG. 5.

Figure 6A:
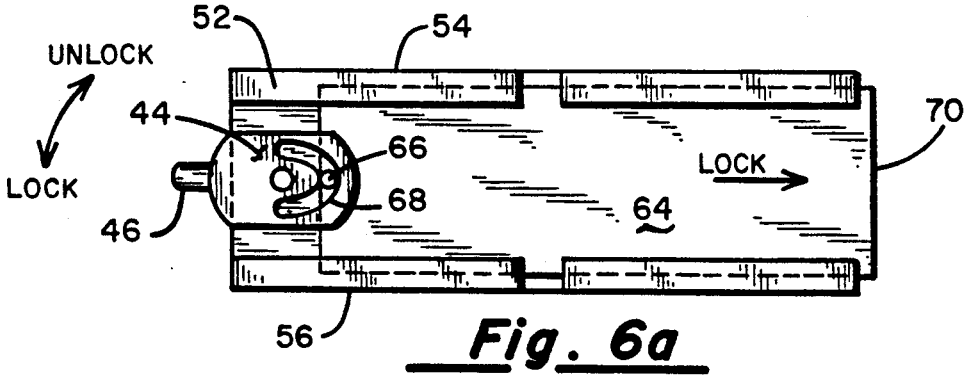
FIG. 6*a* and FIG. 6*b* are views taken along the line 6—6 in FIG. 5 with the slide plate in the locked and unlocked dispositions, respectively.
Figure 6B:
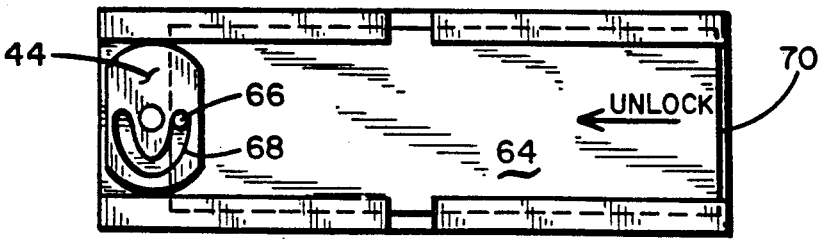

FIGS. 6*a* and 6*b* illustrate a preferred way of securing the airfile adapter 50 to the upper surface of the plate member 12. As can be seen in this Figure, longitudinal grooves are cut in the planar base portion 52 to permit a rectangular side plate 64 to be fitted therein for longitudinal, reciprocal movement. The side plate 64 includes a perpendicularly extending pin 66 which cooperates with a horseshoe-shaped slot 68 formed in the latch plate 44. Thus, the pin 66 and the horseshoe-shaped slot 68 comprise a cam and follower arrangement so that when the latch plate 44 is deployed as indicated in FIG. 6*a*, the end 70 of the slide plate 64 extends outwardly beyond the side walls 54 and 56 of the adapter 50 and can thus be positioned within the undercut portion of a rib 16–22 on the base member 12. When the end 70 extends outwardly as indicated in FIG. 6*a*, the nose portion of the cam 44 also projects outwardly from the forward end of the adapter and it, too, would then fit within an undercut portion of a mating transverse rib to latch the adapter in place.

With reference to FIG. 6*b*, then, when the latch plate 44 is rotated so that its nose portion no longer projects outwardly relative to the forward end of the adapter, the end 70 of the slide plate is also retracted, allowing the adapter to be lifted free of the base member.

The threaded stud 72 extending upwardly from the airfile attachment surface 60 is intended to pass through a mating bore on the airfile so that a nut can be used to secure the airfile to the adapter. In a typical situation, two such adapters would be used with a base plate assembly and the airfile would span the distance between the studs 72 on the pair of adapters. By providing the ability for the airfile attachment surface to pivot relative to the side walls 54 and 56 thereof, a limited degree of flexure of the assembly supporting the abrasive sheet can take place even though the airfile attachment itself is inflexible.

Thus it can be seen that there is provided by this invention a kit including a plurality of abrasive paper backup members of uniform width but varying lengths and constructed so as to be usable with removal handles which can be readily joined to any one member of the kit when that member is selected for use. Each of the members includes a removable base which allows abrasive sheets of differing grits to be readily attached to the sanding apparatus as called for by the particular application but without leaving the replaced abrasive sheet in a dust ladened environment and thus rendered unsuitable for future use.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, it will be recognized that there are alternative ways of removably fastening handle members to the flexible plates and bases other than the cam and latch arrangement specifically illustrated herein. One such variation is that Velcro hook and loop material may be used to releasibly bond the handles to the sanding plates.

What is claimed is:

1. An abrasive sanding kit having component parts capable of being assembled in the field for abrading workpieces of differing shapes, the kit comprising the combination of:

(a) at least one generally flat and rigid plate member having first and second opposed major surfaces, said plate member being of a predetermined length and width dimension and exhibiting limited flexibility in a direction transverse of the length dimension;

(b) a plurality of handle members of differing shape configuration adapted to be individually releasably clamped to said first major surface of said plate member at any one of plural locations along said length dimension; and (c) a plurality of generally planar, elastomeric pads, said pads being adapted for releasable attachment individually to said second major surface of said plate member, said pads adapted to support a strip of abrasive sheet material thereon, the arrangement being such that strips of abrasive sheet material of differing abrasive characteristics can be affixed to different ones of said plurality of pads and a desired one of said pads selected for attachment to said plate member.

2. The apparatus as in claim 1 wherein said handle means includes first and second hand grips disposed at longitudinally spaced locations on said one major surface 3. The apparatus as in claims 1 or 2 wherein said handle means include latch means for selectively latching said handle means to said plate member.

4. The apparatus as in claim 1 wherein said elastomeric pad is secured to said plate member with Velcro®hook and loop material.

5. The apparatus as in claim 1 and further including first and second parallel rails extending longitudinally along the opposed side edges of said plate member for controlling the relative rigidity of said plate member.

6. The apparatus as in claim 1 or 2 and further including at least one pair of transversely extending rib attached to said one major surface of said plate member with said handle means being releasibly secured to said one major surface between said pair of transversely extending ribs whereby said handle means are accurately registered during the attachment of said handle means to said plate member.

7. The apparatus as in claim 1 wherein said plate member is made of Lexan® plastic.

8. The apparatus as in claim 1 wherein said elastomeric pad is a knobby textured neoprene material.

9. The apparatus as in claim 1 wherein said handle means comprises an airfile adapter member.

10. Apparatus for facilitating the abrasive sanding of both flat and arcuate surfaces, comprising:

(a) a generally flat and rigid plate member of a predetermined length and width dimension exhibiting limited flexibility in a direction transverse of the length dimension;

(b) a planar base releasably attachable to one major surface of said plate member;

(c) first and second side walls projecting perpendicularly to said planar base along opposed side edges of said planar base, said side walls sloping from a minimum height at opposing ends to a maximum height midway along the length dimension of said side walls;

(d) an air file attachment surface pivotally supported between said side walls for limited rotation about an axis disposed proximate said maximum height location; and (e) an elastomeric pad releasably attachable to the other major surface of said plate member adapted to support a strip of abrasive sheet material thereon.

11. The apparatus as in claim 10 wherein said plate member includes a pair of transversely extending ribs attached to said one major surface of said plate member with said transverse ribs being undercut.

12. The apparatus as in claim 11 and further including a flat, rectangular slide plate extending between said first and second side walls and slidable therebetween and manually operated cam means operatively disposed between said planar base and said slide plate for selectively urging one end of said slide plate into the undercut portion of said one of said ribs with said cam means extending into the undercut portion of the other of said ribs.

* * * * *